US008077133B2

(12) United States Patent
Miyamoto

(10) Patent No.: US 8,077,133 B2
(45) Date of Patent: Dec. 13, 2011

(54) DRIVING CIRCUIT

(75) Inventor: Kenichi Miyamoto, Miyazaki (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 798 days.

(21) Appl. No.: 11/868,989

(22) Filed: Oct. 9, 2007

(65) Prior Publication Data

US 2008/0117195 A1 May 22, 2008

(30) Foreign Application Priority Data

Nov. 22, 2006 (JP) ..... 2006-315294

(51) Int. Cl.
*G09G 3/36* (2006.01)

(52) U.S. Cl. ..... 345/100; 345/98; 345/204

(58) Field of Classification Search ..... 345/89, 345/690, 90, 92, 98, 100, 204, 205
See application file for complete search history.

(56) References Cited

U.S. PATENT DOCUMENTS

| | | | | |
|---|---|---|---|---|
| 5,731,796 | A | 3/1998 | Furuhashi et al. | |
| 6,127,995 | A | 10/2000 | Furuhashi et al. | |
| 6,256,025 | B1 | 7/2001 | Imai et al. | |
| 6,310,616 | B1 | 10/2001 | Yanagi et al. | |
| 6,323,851 | B1 | 11/2001 | Nakanishi | |
| 6,392,629 | B1 | 5/2002 | Murakami et al. | |
| 6,498,596 | B1 | 12/2002 | Nakamura et al. | |
| 7,079,127 | B2 * | 7/2006 | Morita | 345/212 |
| 7,224,333 | B2 | 5/2007 | Yamazaki et al. | |
| 7,307,610 | B2 * | 12/2007 | Sakaguchi | 345/89 |
| 7,324,079 | B2 | 1/2008 | Tobita | |
| 7,365,713 | B2 | 4/2008 | Kimura | |
| 7,463,254 | B2 | 12/2008 | Shino et al. | |
| 7,479,937 | B2 | 1/2009 | Shimoda | |
| 7,595,776 | B2 | 9/2009 | Hashimoto et al. | |
| 2002/0145600 | A1 * | 10/2002 | Morita | 345/211 |
| 2002/0186231 | A1 | 12/2002 | Kudo et al. | |
| 2004/0021627 | A1 * | 2/2004 | Maki | 345/89 |
| 2004/0179029 | A1 * | 9/2004 | Ogawa et al. | 345/690 |
| 2004/0257388 | A1 | 12/2004 | Tobita | |
| 2005/0057470 | A1 | 3/2005 | Tobita | |
| 2005/0225573 | A1 | 10/2005 | Kudo et al. | |
| 2005/0231452 | A1 | 10/2005 | Tobita | |
| 2007/0057897 | A1 | 3/2007 | Tobita | |
| 2007/0080905 | A1 | 4/2007 | Takahara | |
| 2008/0018633 | A1 | 1/2008 | Nagatomo et al. | |
| 2008/0117195 | A1 | 5/2008 | Miyamoto | |

FOREIGN PATENT DOCUMENTS

| | | |
|---|---|---|
| JP | 2000-165244 | 6/2000 |
| JP | 2005-010276 | 1/2005 |

OTHER PUBLICATIONS

Co-pending U.S. Appl. No. 11/762,250, filed Jun. 13, 2007.

* cited by examiner

*Primary Examiner* — Amare Mengistu
*Assistant Examiner* — Koosha Sharifi-Tafreshi
(74) *Attorney, Agent, or Firm* — Volentine & Whitt, PLLC

(57) ABSTRACT

In a driving circuit of a display device, a period for writing to pixels is shortened while an increase in size of an integrated circuit is avoided. In a first period of the writing period, the pixel is charged up with a gradation potential of a particular node in a node group that includes a node which is at an objective gradation potential. In the first period, a plurality of lines corresponding to the number of nodes included in the node group are connected in parallel between the particular node and the pixel. In a second period of the data-writing period, this parallel connection is cancelled and only the node corresponding to the objective gradation potential is connected to the pixel.

4 Claims, 14 Drawing Sheets

DRIVING CIRCUIT

CROSS-REFERENCE TO RELATED APPLICATION

This application claims priority under 35 USC 119 from Japanese Patent Application No. 2006-315294, the disclosure of which is incorporated by reference herein.

BACKGROUND OF THE INVENTION

1 Field of the Invention

The present invention relates to a driving circuit for driving a data line of a display device and causing pixels to be displayed with numerous gradations.

2 Description of the Related Art

In active matrix-type liquid crystal display devices, which are the dominant type of liquid crystal display device, pixels are selectively driven in pixel units (point sequence driving) or in row units (line sequence driving).

In an active matrix-type liquid crystal display device, pixels which include liquid crystal cells are arrayed in a matrix. Each pixel includes a thin film transistor (TFT) and a storage capacitance which is connected in parallel with the liquid crystal cell. The storage capacitance is provided between a drain of the TFT and a predetermined common potential, and a source of the TFT is connected to a corresponding data line.

In active matrix-type liquid crystal display devices disclosed in Japanese Patent Application Laid-open (JP-A) Nos. 2000-165244 and 2005-010276, scanning lines are sequentially selected by a gate driver, and all the TFTs connected to a selected scanning line (row) are turned on. While the TFTs of the selected row are on, gradation potentials according to display data are provided from a source driver to one end of the storage capacitance of each pixel, via data lines. Hence, the storage capacitances retain charge stored via the data lines for a frame interval.

In recent years, with increases in size of liquid crystal panels (and increases in numbers of data lines), sizes of driving circuits which are source drivers for driving the TFTs have been increasing. As a result, because wiring within the driving circuits has increased, parasitic resistances of the wiring (wiring resistances) have increased, and periods for charging the storage capacitances in the pixels to gradation voltages have become longer. Therefore, with the increase in size of liquid crystal panels of recent years, it has been becoming impossible to satisfactorily assure durations for writing to pixels in the panels.

Meanwhile, increasing the size of a chip for forming a driving circuit, in order to reduce wiring resistances, would be disadvantageous in regard to costs.

SUMMARY OF THE INVENTION

In consideration of the above, it has been desired that a display device driving circuit with which duration for writing to pixels is shortened while an increase in chip size is avoided.

A first aspect of the present invention is a driving circuit that, in accordance with display data, outputs a gradation potential corresponding to the display data from an output terminal, the driving circuit including: a gradation-setting unit that, on the basis of a reference potential, sets a plurality of respectively different gradation potentials at a plurality of nodes, a plurality of amplifiers provided one-to-one at the plurality of nodes, a potential selection unit provided corresponding to the output terminal, the potential selection unit, in a data-writing period, selecting an objective gradation potential that corresponds to the display data from among the plurality of gradation potentials and outputting the objective gradation potential from the amplifier to the output terminal, and a control unit.

The control unit of this driving circuit controls such that, in a first period of the data-writing period, a first node, which is set to the objective gradation potential, and at least one second node neighboring the first node are short-circuited, and a second line, between the second node and the output terminal, is connected in parallel with a first line, between the first node and the output terminal, and in a second period subsequent to the first period, the short-circuit between the first node and the second node is released and the second line is not connected in parallel with the first line. Moreover, the control unit effects a transition from the first period to the second period at a time at which the output terminal reaches a gradation potential corresponding to a predetermined third node among at least one first node and at least one second node.

According to this driving circuit, in the first period, the second line(s) between the second node(s) and the output terminal is/are connected in parallel with the first line between the first node and the output terminal. Therefore, a parasitic resistance between the objective gradation potential (i.e., the first node) and the output terminal is lower than in a case with the first line alone. As a result, a time constant of a circuit between the objective gradation potential and the output terminal is reduced.

A second aspect of the present invention is a driving circuit that, in accordance with display data, outputs a gradation potential corresponding to the display data from an output terminal, the driving circuit including: a gradation-setting unit that, on the basis of a reference potential, sets a plurality of respectively different gradation potentials at a plurality of nodes, a plurality of amplifiers provided one-to-one at the plurality of nodes, a potential selection unit provided corresponding to the output terminal, the potential selection unit, in a data-writing period, selecting an objective gradation potential that corresponds to the display data from among the plurality of gradation potentials and outputting the objective gradation potential from the amplifier to the output terminal, and a control unit.

The control unit of this driving circuit controls such that, in a first period of the data-writing period, a second line, between at least one second node neighboring a first node and the output terminal, is connected in parallel with a first line, which is between the first node and the output terminal, the first node being set to the objective gradation potential, and in a second period subsequent to the first period, the second line is not connected in parallel with the first line. Moreover, the control unit effects a transition from the first period to the second period at a time at which the output terminal reaches the lowest gradation potential of the gradation potentials set at the first node and the second node.

According to the present invention, a period for writing to pixels is shortened in comparison with heretofore. Moreover, compared with heretofore, there are no additional structural elements, and an increase in size of an integrated circuit that structures the driving circuit is avoided.

DETAILED DESCRIPTION OF THE INVENTION

First Embodiment

Overall Structure of Liquid Crystal Display Device

Figure 1:
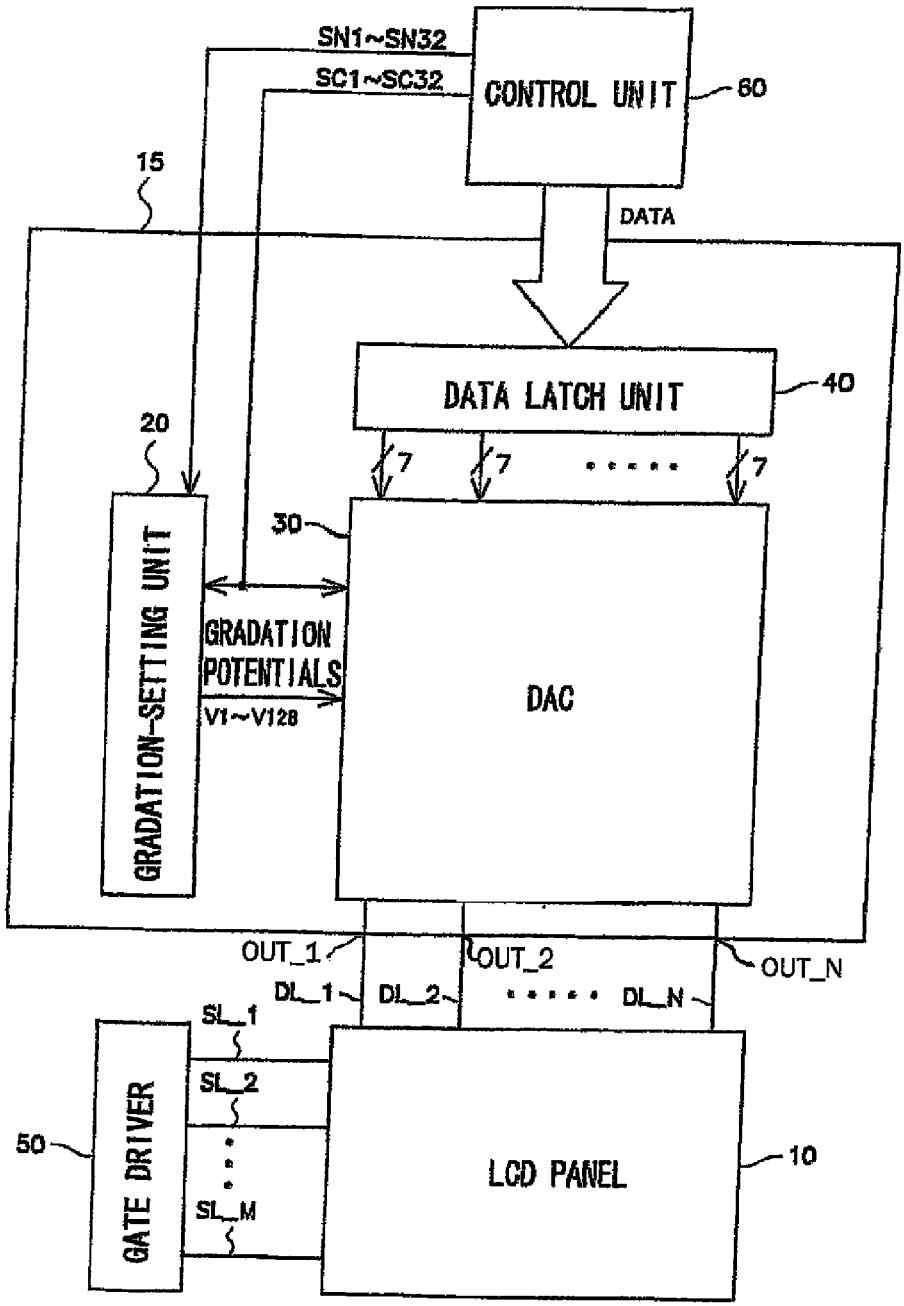
FIG. 1 is a block diagram showing structure of a liquid crystal display device in which a driving circuit of a first embodiment is applied.

Firstly, overall structure of a liquid crystal display device in which a driving circuit relating to an embodiment of the present invention is applied will be described with reference to FIG. 1. FIG. 1 is a block diagram showing structure of the liquid crystal display device.

For the present embodiment, a liquid crystal display device which processes 128-level (7-bit) display data will be described as an example, but the embodiment could be easily extended to display data for a different number of levels (i.e., data other than 7-bit data).

As shown in FIG. 1, this liquid crystal display device has a liquid crystal display panel (LCD panel) 10, a source driver 15, a gate driver 50 and a control unit 60. The source driver 15 and the control unit 60 constitute an embodiment of the driving circuit of the present invention.

In the LCD panel 10, pixels (not illustrated) are arrayed in a matrix of M rows by N columns. This matrix of pixels is connected to and driven by M scanning lines (SL_1, SL_2, . . . , SL_M) and N data lines (DL_1, DL_2, . . . , DL_N).

Each pixel includes a thin film transistor (TFT) and a storage capacitance Cs which is connected in parallel with a liquid crystal cell. The storage capacitance Cs is provided between the drain of the TFT and a predetermined common potential, and stores an accumulated charge over a frame period. The source of the TFT is connected to a corresponding data line.

In this liquid crystal display device, the scanning lines are sequentially selected by the gate driver 50, and the TFTs of all pixels connected to a selected scanning line (i.e., a row) are turned on. While the TFTs of the selected row are on, gradation potential voltages according to display data are supplied from output terminals of the source driver 15 (OUT_1, OUT_2, . . . , OUT_N, not shown) to the pixels of that row (i.e., to the storage capacitances) via the data lines. An output terminal of the source driver 15 corresponds to an output terminal of the driving circuit of the present invention.

The control unit 60 is a control unit for controlling the source driver 15. The control unit 60 sequentially sends display data acquired from an external unit (DATA) to the source driver 15, and controls the source driver 15 with control signals SC1 to SC32 and SN1 to SN32.

Structure of the source driver 15 and details of control by the control unit 60 will be described in this order herebelow.

Structure of Driving Circuit

Figure 2:
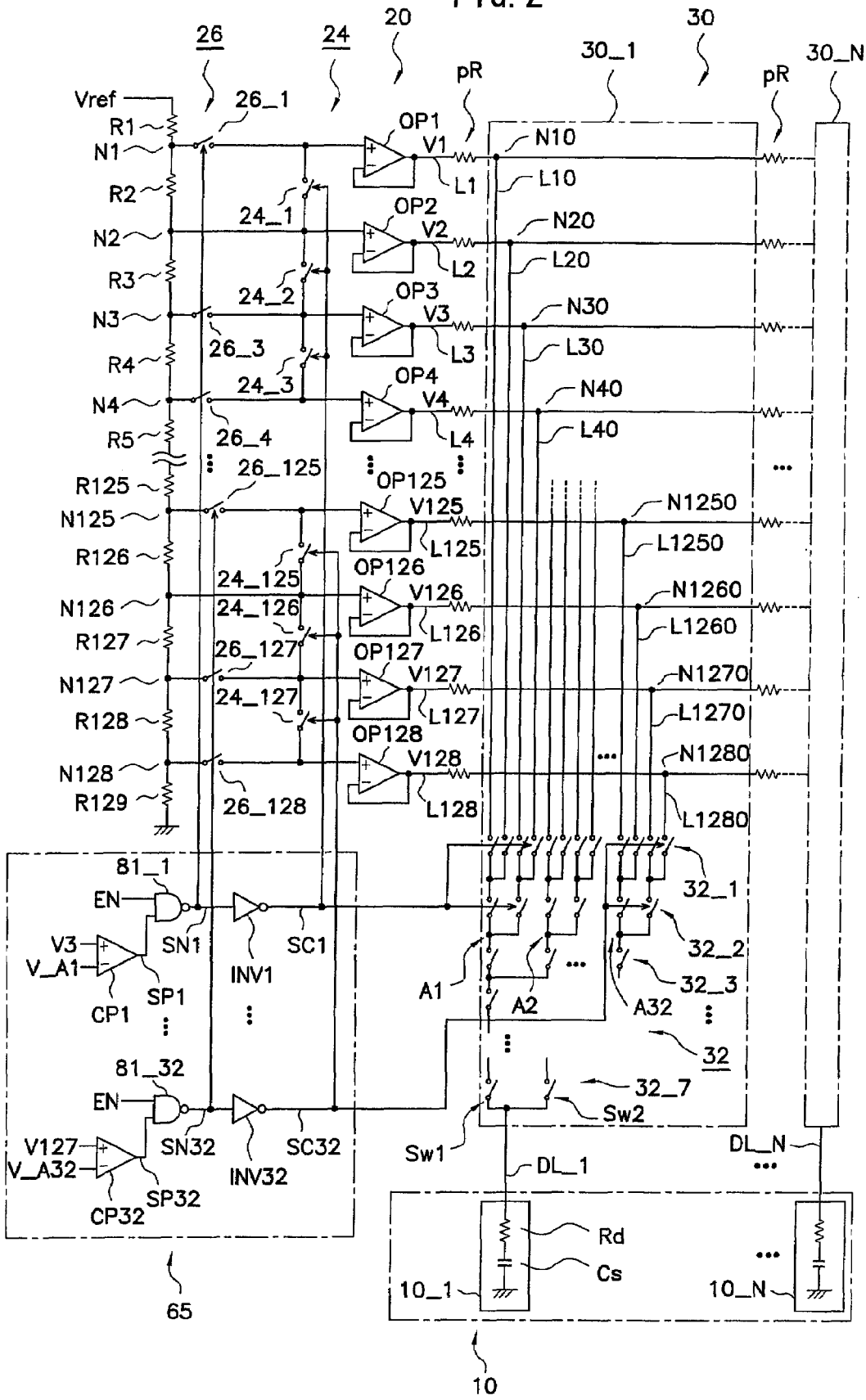
FIG. 2 is a diagram showing an example of circuit structure of a source driver and control unit structuring the driving circuit of the first embodiment.

Next, a specific circuit structure example of the source driver 15 will be described with reference to FIG. 1 and FIG. 2. FIG. 2 is a diagram showing an example of circuit structure of a portion of the source driver 15. In FIG. 2, the output terminals of the source driver 15 (OUT_1, OUT_2, . . . , OUT_N) are not depicted.

As shown in FIG. 1, the source driver 15 includes a gradation-setting unit 20, a digital-analog converter (DAC) 30, which serves as a potential selection unit, and a data latch unit 40.

The data latch unit 40 reads and latches display data from the control unit 60 synchronously with a strobe signal (not illustrated) from the control unit 60, and outputs 7-bit display data corresponding to the respective data lines to the digital-analog converter 30.

The gradation-setting unit 20 generates gradation potentials V1 to V128 on the basis of a predetermined reference potential. The digital-analog converter 30 selects gradation potentials (analog data) corresponding to the 7-bit display data (digital data) from among the gradation potentials V1 to V128, and sends the selected gradation potentials to the data lines.

Next, of structure of the source driver 15, structure of the gradation-setting unit 20 and the digital-analog converter 30 will be described in more detail with reference to FIG. 2. In FIG. 2, for the sake of simplicity, only pixels 10_1 to 10_N, corresponding to one row of the LCD panel 10, are depicted. Each pixel is shown as an equivalent circuit including a storage capacitance Cs and an on-resistance Rd of the TFT. A control signal generation unit 65 in the control unit 60 is also depicted in FIG. 2.

In FIG. 2, the gradation-setting unit 20 includes resistances R1 to R129, operational amplifiers OP1 to OP128 (i.e., a plurality of amplifiers) and switch groups 24 and 26.

The resistances R1 to R129 are resistances for generating the gradation potentials, and are provided in series between a reference potential Vref and a ground potential. Accordingly, the respective gradation potentials V1, V2, . . . , V128 (V1>V2> . . . >V128) are provided at nodes between the resistances, which is to say, a node N1 between resistance R1 and resistance R2, a node N2 between resistance R2 and resistance R3, . . . , and a node N128 between resistance R128 and resistance R129. Here, in order to implement gamma correction of the gradation-setting unit 20, it is possible, for example, for the resistance R1 and the resistance R129 to be variable resistances, and for resistance values of the resistance R1 and/or the resistance R129 to be altered in accordance with control signals from the control unit 60.

The nodes N1 to N128 of the gradation-setting unit 20 are structured by a plurality of node groups, in order of magnitude of the gradation potentials. In this embodiment, four neighboring nodes constitute a single node group. That is, the nodes N1 to N128 of the gradation-setting unit 20 are constituted of 32 node groups: a node group GN1 including nodes N1 to N4, a node group GN2 including nodes N5 to N8, . . . , and a node group GN32 including nodes N125 to N128. As will be described later, in this source driver 15, when a node that is at an objective gradation potential is included in a particular node group, all nodes included in that node group will be controlled so as to be short-circuited.

The op amps OP1 to OP128 are provided in respective correspondence with the above-mentioned nodes. That is, non-inverting input terminals (+) of the op amps OP1 to OP128 are connected to the nodes N1 to N128, respectively. The inverting input terminals (−) of the op amps OP1 to OP128 are connected to the output terminals of the same. Therefore, each op amp constitutes a voltage follower for implementing impedance conversion, and a voltage drop due to supplying current when a gradation potential is being applied to pixels is prevented.

As shown in FIG. 2, the switch group 24 includes a switch 24_1 provided between node N1 and node N2, a switch 24_2 provided between node N2 and node N3 and a switch 24_3 provided between node N3 and node N4, . . . , and a switch 24_125 provided between node N125 and node N126, a switch 24_126 provided between node N126 and node N127 and a switch 24_127 provided between node N127 and node N128. The switches of the switch group 24 are controlled for opening and closing by the control signals SC1 to SC32 from the control unit 60.

As shown in FIG. 2, the switch group 26 includes a switch 26_1 provided between node N1 and the non-inverting input terminal of op amp OP1, a switch 26_3 provided between node N3 and the non-inverting input terminal of op amp OP3 and a switch 26_4 provided between node N4 and the non-inverting input terminal of op amp OP4, . . . , and a switch 26_125 provided between node N125 and the non-inverting input terminal of op amp OP125, a switch 26_127 provided between node N127 and the non-inverting input terminal of op amp OP127 and a switch 26_128 provided between node N128 and the non-inverting input terminal of op amp OP128. The switches of the switch group 26 are controlled for opening and closing by the control signals SN1 to SN32 from the control unit 60.

As shown in FIG. 2, at each node group of the gradation-setting unit 20, a switch is not provided between the node with the second highest gradation potential and the non-inverting input terminal of the corresponding op amp. For example, no switch is provided between node N2 of node group GN1 and the non-inverting input terminal of op amp OP2.

At the digital-analog converter 30 serving as the potential selection unit, a plurality of D-A converters 30_1 to 30_N are provided, corresponding to the pixels arrayed in the column direction in the LCD panel 10. The D-A converters 30_1 to 30_N supply gradation potentials corresponding to display data to the storage capacitances Cs of the corresponding pixels, via the data lines. In FIG. 2, the D-A converters 30_1 to 30_N supply the gradation potentials to the pixels 10_1 to 10_N, respectively, via the data lines DL_1 to DL_N.

Each D-A converter is structured between lines L1 to L128, which are provided at the output terminals of the op amps OP1 to OP128, and the corresponding data line. Structures of the D-A converters are all the same. Therefore, only structure of the D-A converter 30_1 will be described herebelow.

The D-A converter 30_1 includes a switch group 32. The switch group 32 is controlled for opening and closing in accordance with 7 bits of display data (digital data), converts this display data to a gradation potential (analog data), and outputs the gradation potential to the data line DL_1 (i.e., the D-A converter 30_1 is equivalent to an output terminal of the driving circuit).

The switch group 32 includes switch device groups 32_1 to 32_7 which operate in accordance with, respectively, the bits of the 7-bit data (display data) provided from the data latch unit 40. Each switch device group is structured to include one or a plurality of switch devices, which are pairs of switches. Of such a pair of switches (hereafter referred to as SW1 and SW2), one opens and the other closes in accordance with the level of the corresponding bit.

For example, as shown in FIG. 2, the switch device group 32_7 includes one pair of switches SW1 (the switch at the left side in FIG. 2) and SW2 (the switch at the right side in FIG. 2). When the level of an MSB (most significant bit) of the display data is zero, switch SW1 is closed and switch SW2 is open, and when the level is one, switch SW1 is open and switch SW2 is closed.

Similarly, the switch device group 32_6 (not shown) includes two pairs of switches (SW1 and SW2). When the level of a second most significant bit of the 7-bit display data is zero, of every pair, switch SW1 is closed and switch SW2 is open, and when the level is one, switch SW1 is open and switch SW2 is closed.

The switch device group 32_5 (not shown) includes four pairs of switches (SW1 and SW2). When the level of a third most significant bit of the 7-bit display data is zero, of every pair, switch SW1 is closed and switch SW2 is open, and when the level is one, switch SW1 is open and switch SW2 is closed.

The switch device group 32_4 (not shown) includes eight pairs of switches (SW1 and SW2). When the level of a fourth most significant bit of the 7-bit display data is zero, of every pair, switch SW1 is closed and switch SW2 is open, and when the level is one, switch SW1 is open and switch SW2 is closed.

The switch device group 32_3 includes 16 pairs of switches (SW1 and SW2). When the level of a fifth most significant bit of the 7-bit display data is zero, of every pair, switch SW1 is closed and switch SW2 is open, and when the level is one, switch SW1 is open and switch SW2 is closed.

The switch device group 32_2 (not shown) includes 32 pairs of switches (SW1 and SW2). When the level of a sixth most significant bit of the 7-bit display data is zero, of every pair, switch SW1 is closed and switch SW2 is open, and when the level is one, switch SW1 is open and switch SW2 is closed.

The switch device group 32_1 includes 64 pairs of switches (SW1 and SW2). When the level of an LSB (least significant bit) of the 7-bit display data is zero, of every pair, switch SW1 is closed and switch SW2 is open, and when the level is one, switch SW1 is open and switch SW2 is closed.

As shown in FIG. 2, the switch device groups 32_1 to 32_7 are sequentially connected to the data line DL_1 by a tree structure.

One ends of the 128 switches (64 pairs of switches) of the switch device group 32_1 (i.e., ends that are not connected to the switch device group 32_2) are connected with nodes N10 to N1280 on the lines L1 to L128, respectively, by lines L10 to L1280.

In FIG. 2, there are parasitic resistances pR on the lines L1 to L128 in the source driver 15. Moreover, there are parasitic resistances pR (not shown) on the lines L10 to L1280 in the source driver 15.

Next, a structural example of the control signal generation unit 65 of the control unit 60 will be described with reference to FIG. 2.

As shown in FIG. 2, the control signal generation unit 65 includes comparators CP1 to CP32, NAND circuits 81_1 to 81_32, and inverters INVI to INV32. The control signal generation unit 65 generates the control signals SN1 to SN32 and the control signals SC1 to SC32.

The comparators, NAND circuits and the invertors in the control signal generation unit 65 are provided in respective correspondence with the node groups. That is, the comparator CP1, NAND circuit 81_1, and inverter INV1 are provided in correspondence with node group GN1 (i.e., nodes N1 to N4), and generate the control signals SN1 and SC1; and the comparator CP32, NAND circuit 81_32, and inverter INV32 are provided in correspondence with node group GN32 (i.e., nodes N125 to N128), and generate the control signals SN32 and SC32.

The gradation potential of the third node in each node group is provided to a non-inverting input terminal of one of the comparators CP1 to CP32. For example, the gradation potential V3 of node N3 in node group GN1 is provided to the non-inverting input terminal of comparator CP1, and the gradation potential V127 of node N127 in node group GN32 is provided to the non-inverting input terminal of comparator CP32.

Potentials V_A1 to V_A32, at nodes A1 to A32 within the switch group 32, are provided to the inverting input terminals of the comparators CP1 to CP32. These nodes A1 to A32 are 32 nodes disposed at the pixel 10_1 side of the switch device group 32_2. The nodes A1 to A32 correspond to the 32 node groups GN1 to GN32. For example, node A1 corresponds, via the switch device groups 32_1 and 32_2 and the nodes N10 to N40, with nodes N1 to N4 of the node group GN1, and node A32 corresponds, via the switch device groups 32_1 and 32_2 and the nodes N1250 to N1280, with nodes N125 to N128 of the node group GN32.

Each of the NAND circuits 81_1 to 81_32 implements a NAND calculation between an enable signal EN and an output signal of the corresponding comparator (one of signals SP1 to SP32), to generate the control signals SN1 to SN32. The enable signal EN is continuously at a high (H) level during a period of writing to the pixels. The control signals SC1 to SC32 are generated as inverted signals of the control signals SN1 to SN32, respectively.

The control signals SN1 to SN32 control opening and closing of the switches of the switch group 26 that are connected to the respectively corresponding node groups. For example, when the control signal SN1 is at a low (L) level, the switches 26_1, 26_3 and 26_4 connected to node group GN1 are opened and when the control signal SN1 is at an H level, the switches 26_1, 26_3 and 26_4 are closed. When the control signal SN32 is at the L level, the switches 26_125, 26_127 and 26_128 connected to node group GN32 are opened and when the control signal SN32 is at the H level, the switches 26_125, 26_127 and 26_128 are closed.

The control signals SC1 to SC32 control opening and closing of the switches of the switch groups 24 that are connected to the respectively corresponding node groups. For example, when the control signal SC1 is at the low (L) level, the switches 24_1, 24_2 and 24_3 connected to node group GN1 are opened and when the control signal SC1 is at the H level, the switches 24_1, 24_2 and 24_3 are closed. When the control signal SC32 is at the L level, the switches 24_125, 24_126 and 24_127 connected to node group GN32 are opened and when the control signal SC32 is at the H level, the switches 24_125, 24_126 and 24_127 are closed.

In addition, when the control signals SC1 to SC32 are at the H level, switches in the switch device groups 32_1 and 32_2 that are connected to the corresponding node groups are closed. For example, when the control signal SC1 is at the H level, all switches between node A1 and nodes N1 to N4 are closed, and when the control signal SC32 is at the H level, all switches between node A32 and nodes N125 to N128 are closed.

When the control signals SC1 to SC32 are at the L level, opening/closing states of the switch device groups 32_1 and 32_2 are controlled in accordance with the 7-bit data (display data) provided to the digital-analog converter 30 from the data latch unit 40.

Details of Control by the Control Unit

Next, details of control of the source driver 15 by the control unit 60 will be described.

In a period of writing to the pixels, control by the control unit 60 differs between a first period, in which the output signals (SC1 to SC32) of the comparators (CP1 to CP32) of the control signal generation unit 65 are at the H level, and a second period, after these output signals (SC1 to SC32) have switched to the L level. For example, if a node at an objective gradation potential is included in the node group GN1 (nodes N1 to N4), the first period is while the output signal SC1 of the comparator CP1 corresponding to the node group GN1 is at the H level, and the second period is while the same is at the L level.

In the initial first period of the period of data-writing, the control unit 60 opens/closes the switch group 32 in accordance with the display data, and the switch device groups 32_1 and 32_2 corresponding to the two least significant bits of the display data are all closed by the control signal SC1, regardless of the display data (i.e., are in a closed state).

In the first period, the control unit 60 closes all switches of the switch group 24 between all the nodes of the node group that includes the node at the objective gradation potential according to the display data (i.e., the switches are in closed states). For example, if the objective gradation potential according to the display data is V3, all the switches 241, 24_2 and 24_3 between the nodes of node group GN1, which includes node N3, are closed.

In the first period, the control unit 60 opens all switches of the switch group 26 that are connected to the nodes of the node group that includes the node at the objective gradation potential according to the display data (i.e., the switches are in opened states). For example, if the objective gradation potential according to the display data is V3, all the switches 26_1, 26_3 and 26_4 connected to all the nodes of N1, N3 and N4 of node group GN1, which includes node N3, are opened.

Thus, in the case in which the objective gradation potential is V3, in the first period, the nodes N1 to N4 are at the same potential (which is gradation potential V2).

In the following descriptions, the switching control in which the switch device groups 32_1 and 32_2 are closed regardless of display data is referred to as a "short-circuit control mode". This short-circuit control mode is implemented only in the first period.

In the data-writing period, when the control unit 60 goes on from the first period to the second period, the closing of the switch device groups 32_1 and 32_2 which is unrelated to the display data is released. Hence, in the second period, the short-circuit control mode is not implemented but the switch group 32 are opened/closed in accordance with the display data.

In the second period, the control unit 60 opens all the switches of the switch group 24 between the nodes of the node group that includes the node at the objective gradation potential according to the display data (i.e., the switches are in opened states). For example, if the objective gradation potential according to the display data is V3, the switches 24_1, 24_2 and 24_3 between the nodes of the node group GN1 are all opened.

In the second period, the control unit 60 closes all the switches of the switch group 26 connected to the nodes of the node group that includes the node at the objective gradation potential according to the display data (i.e., the switches are in closed states). For example, if the objective gradation potential according to the display data is V3, the switches 26_1, 26_3 and 26_4 connected to all the nodes of N1, N3 and N4 of the node group GN1 are all closed.

Thus, in the second period, when the objective gradation potential is V3, node N3 is electrically cut off from the other nodes of node group GN1, and the gradation potential V3 is provided to the pixel 10_1.

Operation of the Driving Circuit

Figure 3:
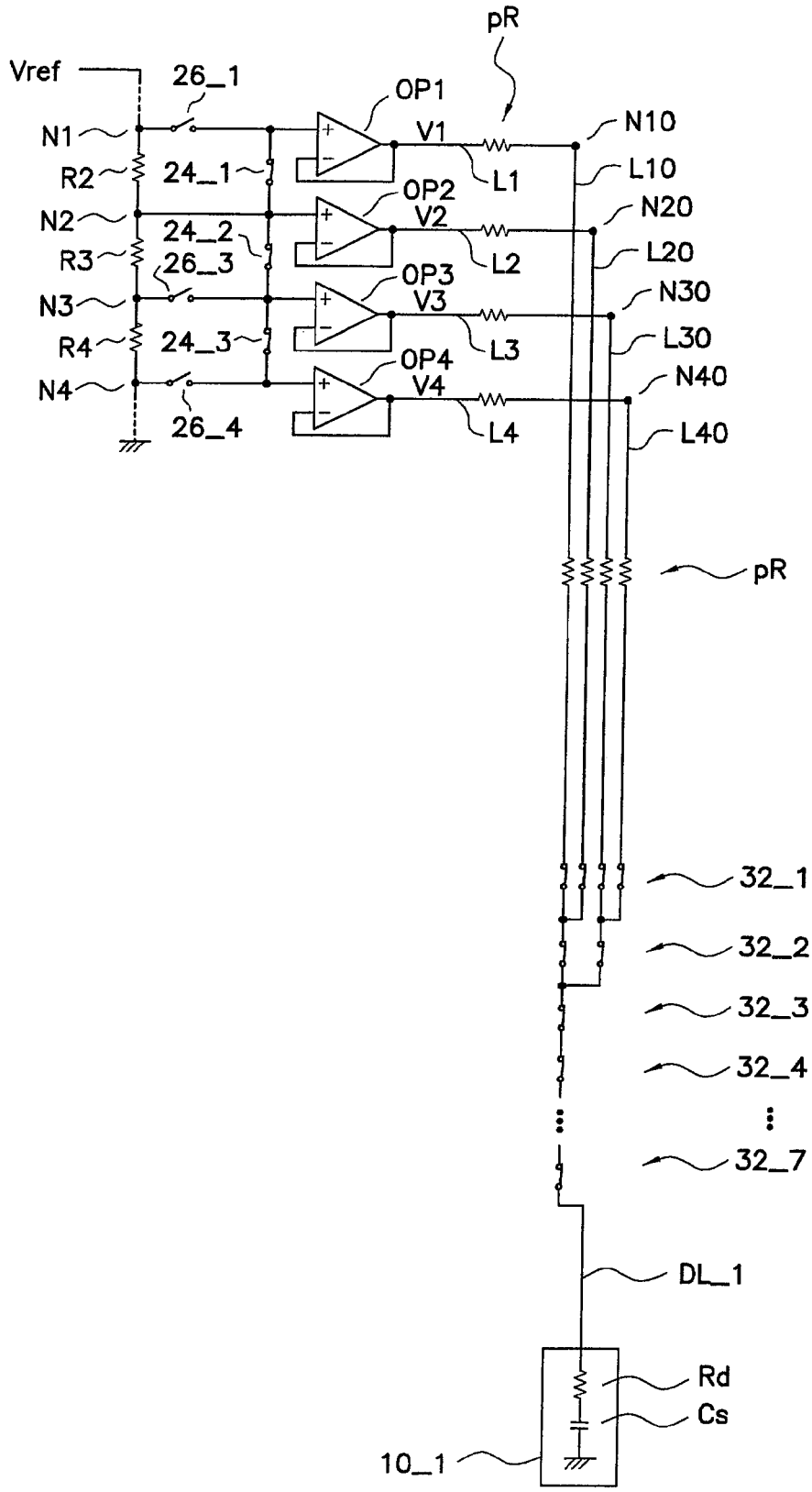
FIG. 3 is a diagram showing an example of an equivalent circuit, in a first period, of the source driver structuring the driving circuit of the first embodiment.

Next, operation of the driving circuit relating to the embodiment will be described with reference to FIG. 3 to FIG. 5. FIG. 3 is a diagram showing an equivalent circuit of the source driver 15 in the first period when an objective gradation potential is one of V1 to V4. FIG. 4 is a timing chart showing operation of the source driver 15 when the objective gradation potential is one of V1 to V4. FIG. 5 is a timing chart showing operation of the source driver 15 when the objective gradation potential is one of V125 to V128.

Figure 4A:
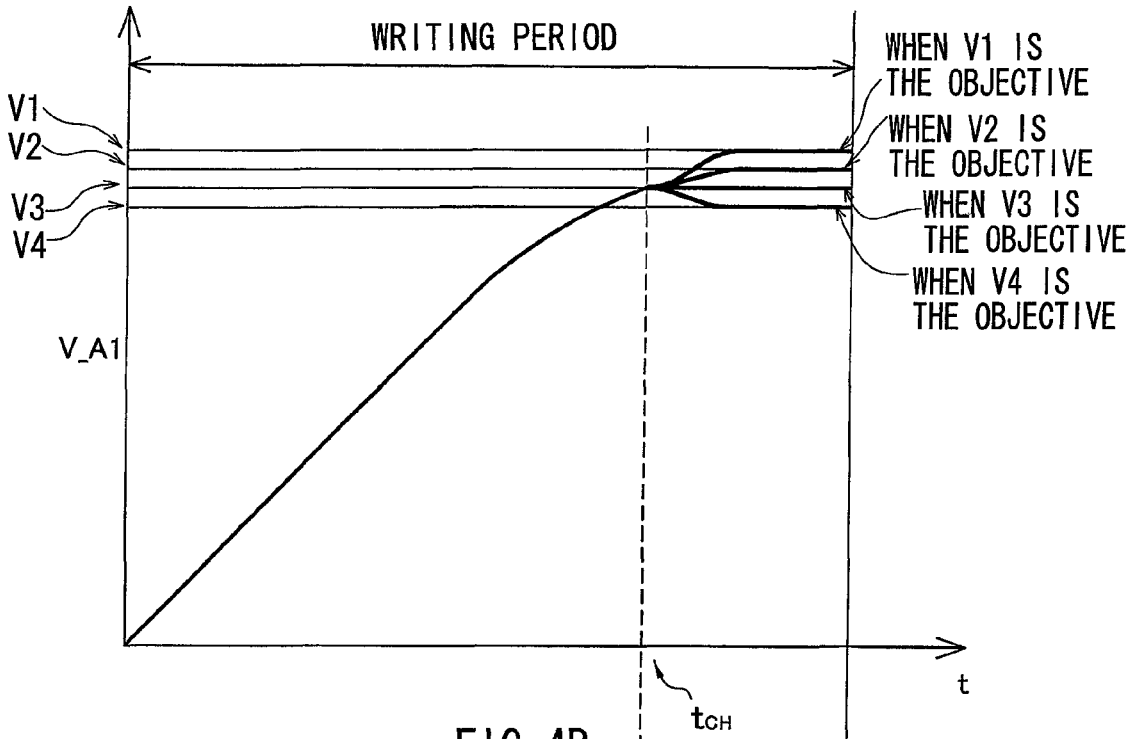
FIG. 4 is a timing chart showing operation of the driving circuit of the first embodiment (when an objective gradation potential is high).
Figure 4B:
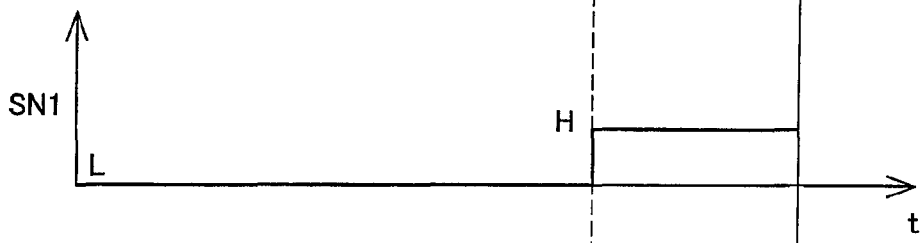
Figure 4C:
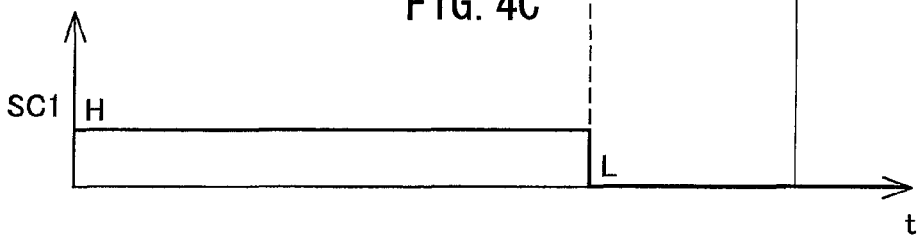
Figures 5A, 5B, 5C:
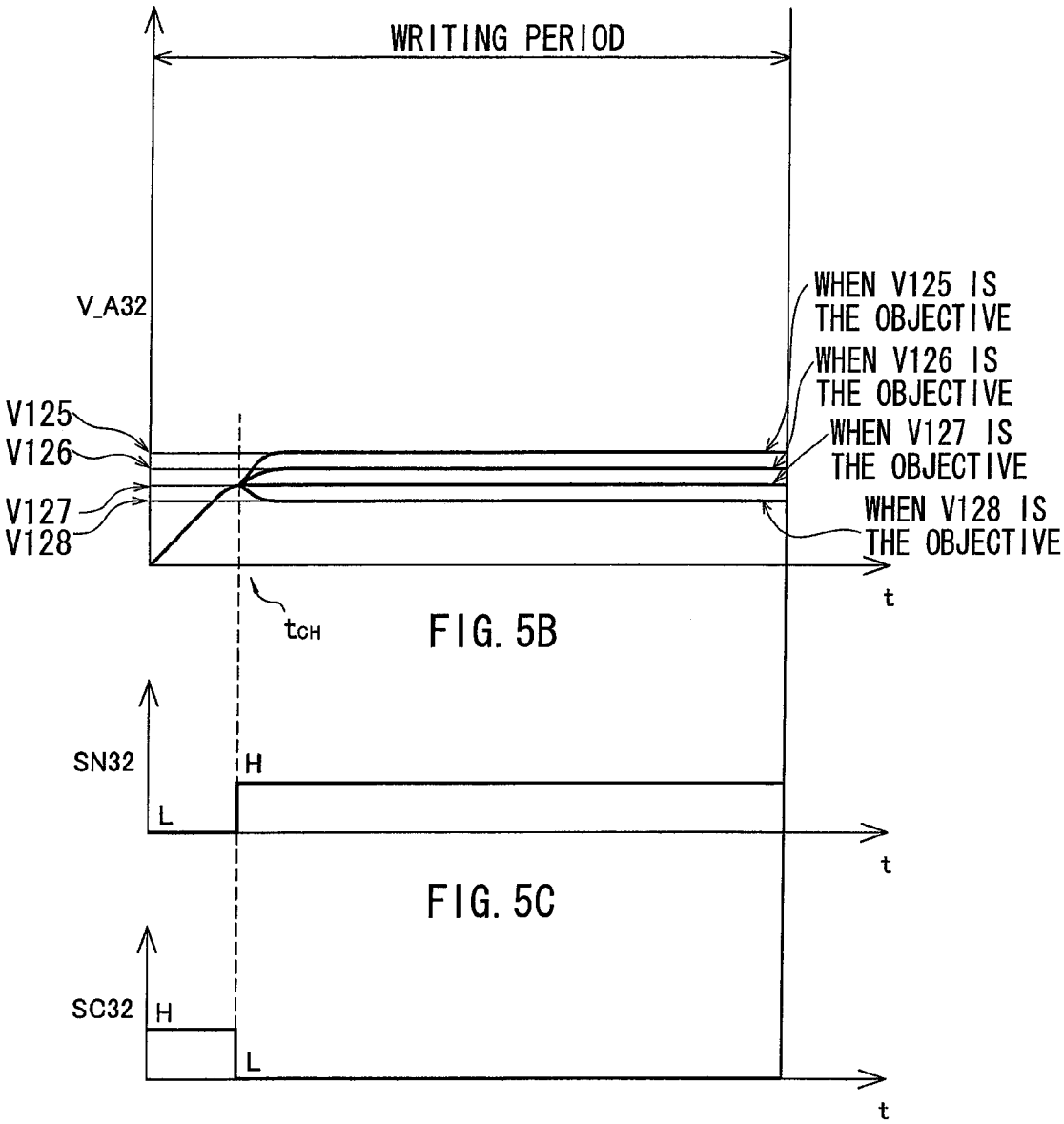
FIG. 5 is a timing chart showing operation of the driving circuit of the first embodiment (when the objective gradation potential is low).

FIG. 4A shows the potential V_A1 at the node A1, FIG. 4B shows the control signal SN1, and FIG. 4C shows the control signal SC1. In FIG. 5A shows the potential V_A32 at the node A32, FIG. 5B shows the control signal SN32, and FIG. 5C shows the control signal SC32. Note that in FIG. 4 and FIG. 5, so as to ease understanding of transient responses of pixel potentials according to the present embodiment, 0 V is set as an origin point for convenience. However, in an actual liquid crystal display device, potentials that are supplied to the pixels will be subjected to AC driving of a common potential, which will switch with a period of 1F (the duration of one frame) or the like. Therefore, pixel potentials at the commencements of writing periods in continuous display operations will constantly vary as time progresses.

Firstly, operation in a period of writing in a case in which the objective gradation potential is at one of the node group GN1, for example, a case in which the objective gradation potential is V2, will be described with reference to FIG. 3 and FIG. 4.

When the gradation potential V2 is to be supplied to the pixel 10_1 as the objective gradation potential, 7-bit data "0000001" is sent as is the display data from the control unit 60 to the source driver 15. When this display data is received, in the switch group 32 of the source driver 15, at all of the switch pairs (SW1 and SW2) in the switch device groups 32_2 to 32_7, switch SW1 closes and switch SW2 opens, while at all the switch pairs (SW1 and SW2) of the switch device group 32_1, switch SW1 opens and switch SW2 closes.

In the initial first period of the writing period, pixel 10_1 is not completely charged up but the potential V_A1 of node A1 is below the potential V3 of node N3. Therefore, the output signal SP1 of the comparator CP1 is at the H level, and as shown in FIG. 4, the control signal SN1 is at the L level and the control signal SC1 is at the H level. As a result, the switches 26_1, 26_3 and 26_4 are open, and the switches 24_1, 24_2 and 24_3 are closed. Moreover, the switches of the switch device groups 32_1 and 32_2 corresponding to the bottom two bits of the display data are all closed regardless of the display data (the short-circuit control mode). Thus, an equivalent circuit of the source driver 15 in this first period can be represented as in FIG. 3.

As shown by the equivalent circuit of FIG. 3, in the first period, all the nodes N1 to N4 in the node group GN1 including node N2, which is at the objective gradation potential, are short-circuited, and four wiring paths corresponding with the nodes N1 to N4 are connected in parallel: that is, a wiring path including line L1, node N10 and line L10, a wiring path including line L2, node N20 and line L20, a wiring path including line L3, node N30 and line L30, and a wiring path including line L4, node N40 and line L40. Therefore, while the pixel 10_1 is being charged up via the data line DL_1, a parasitic resistance pR falls to about a quarter compared to a case in which the above-described short-circuit control mode is not applied. The reason for this is that the time constant of a CR circuit structured by the storage capacitance Cs of pixel 10_1 and the parasitic resistance pR falls to about a quarter compared to a case in which the short-circuit control mode is not applied.

As charging of the pixel 10_1 progresses, the potential V_A1 of node A1 rises above the potential V3 of node N3 (at time $t_{CH}$ in FIG. 4), and the output signal SP1 of the comparator CP1 switches from the H level to the L level. The second period is from this time $t_{CH}$. In the second period, as shown in FIG. 4, the control signal SN1 is at the H level and the control signal SC1 is at the L level. Therefore, the switches 26_1, 26_3 and 26_4 are closed, and the switches 24_1, 24_2 and 24_3 are opened. In addition, the switches of the switch device groups 32_1 and 32_2 corresponding to the bottom two bits of the display data open and close in accordance with the display data (i.e., the short-circuit control mode is released).

Thus, in the second period, a line from the node N2 which is at the objective gradation potential to the data line DL_1 changes from the parallel structure of the first period to a single wiring path structure featuring line L2, node N20 and line L20.

FIG. 4 shows operation waveforms for cases of objective gradation potentials of V1 to V4 (the gradation potentials of node group GN1) in addition to the case in which the objective gradation potential is V2. As shown in FIG. 4, when the objective gradation potential is the potential of any node in node group GN1, in the first period, the pixel 10_1 is charged up with the gradation potential of the second gradation potential V2 of the node group GN1, regardless of the objective gradation potential. Then, in the second period, the nodes of node group GN1 are electrically separated and a gradation potential according to the display data is supplied to the pixel 10_1.

Next, operations in a writing period in a case in which the objective gradation potential is at any of node group GN32 will be described with reference to FIG. 5. Also in such a case, operations are similar to a case in which the objective gradation potential is at any of node group GN1 (FIG. 4).

That is, in the first period, all of the nodes N125 to N128 in the node group GN32 that includes the node which is at the objective gradation potential are short-circuited, and four wiring paths corresponding with the nodes N125 to N128 are connected in parallel: that is, a wiring path including line L125, node N1250 and line L1250, a wiring path including line L126, node N1260 and line L1260, a wiring path including line L127, node N1270 and line L1270, and a wiring path including line L128, node N1280 and line L1280. Therefore, while the pixel 10_1 is being charged up via the data line DL_1, a parasitic resistance pR falls to about a quarter compared to a case in which the above-described short-circuit control mode is not applied. As a result, the time constant of the CR circuit structured by the storage capacitance Cs of pixel 10_1 and the parasitic resistance pR falls to about a quarter compared to a case in which the short-circuit control mode is not applied.

In the second period, a line from the node at the objective gradation potential to the data line DL_1 changes from the parallel structure of the first period to a single wiring path structure.

Now, the gradation potentials of node group GN32 are much smaller than the gradation potentials of node group GNi. Therefore, as shown in FIG. 5, the time $t_{CH}$ of switching from the first period to the second period is much earlier than in the case shown in FIG. 4.

FIG. 5 shows operation waveforms for cases of objective gradation potentials of VI25 to V128 (the gradation potentials of node group GN32). As shown in FIG. 5, when the objective gradation potential is the potential of any node in node group GN32, in the first period, the pixel 10_1 is charged up with the gradation potential of the second gradation potential V126 of the node group GN32, regardless of the objective gradation potential. Then, in the second period, the nodes of node group GN32 are electrically separated and a gradation potential according to the display data is supplied to the pixel 10_1.

As has been described above, according to the driving circuit of the present embodiment, in a first period of a writing period, which is to say a time from a commencement of writing until a pixel is substantially charged, the pixel is charged up by a gradation potential of a particular node in a node group that includes a node which is at an objective gradation potential, and a plurality of lines corresponding in number to the number of nodes included in the node group are connected in parallel between the particular node and the pixel. As a result, a time constant during the charging of the first period is reduced. In a second period of the writing period, which is to say a period after the pixel has been charged up to close to the objective gradation potential, the above-mentioned parallel connections are cancelled and only the node corresponding to the objective gradation potential is connected to the pixel.

Thus, with this driving circuit, an overall data-writing period can be shortened. Therefore, data-writing periods can be shortened even in cases in which LCD panels are increased in size and wiring resistances within driving circuits are increased in number.

Furthermore, the driving circuit of the present embodiment is structured such that the timing of transition from the first period to the second period varies in accordance with a potential of the node group that includes the node at the objective gradation potential.

If, in the writing period, the timing for switching from the first period to the second period were to be fixed, and particularly if the objective gradation potential was low, then (1) delays in actual charging periods and (2) occurrences of offset currents between neighboring op amps (of OP1 to OP128) would occur. That is, if the timing of the transition from the first period to the second period was fixed, the first period would be set to a length for when the charging period was longest, that is, when the objective gradation potential was highest (for example, when the objective gradation potential was one of V1 to V4). However, with the first period being set so long, where a shorter charging period would suffice, that is, where the objective gradation potential was lower (for example, if the objective gradation potential was one of V125 to V128), then: (1) even though charging to close to the objective gradation potential would finish in a short period, it would be necessary to wait until the end of the long first period before finally charging to the objective gradation potential; and (2) because the short-circuit control mode would continue even after charging to close to the objective gradation potential, offset currents caused by manufacturing variations between individual op amps would flow between neighboring op amps.

With the driving circuit of the present embodiment, as has been described with reference to FIG. 5, the short-circuit control mode is released after a short period (i.e., the first period finishes in a short duration) when the objective gradation potential is low. Therefore, the above-mentioned issues (1) and (2) will be avoided.

Modified Example

Now, the gradation potential for performing charging of a pixel in the first period (i.e., in the above-described embodiment, V2 for node group GN1 and V126 for node group GN32) may be arbitrarily selected in advance from the gradation potentials of the node group that includes the node at the objective gradation potential. As a modified example of the driving circuit of the first embodiment, a driving circuit structure is shown in FIG. 6, in which the gradation potential for performing charging of the pixel in the first period is the largest gradation potential in the node group that includes the node at the objective gradation potential (i.e., V1 for node group GN1 and V125 for node group GN32).

Figure 6:
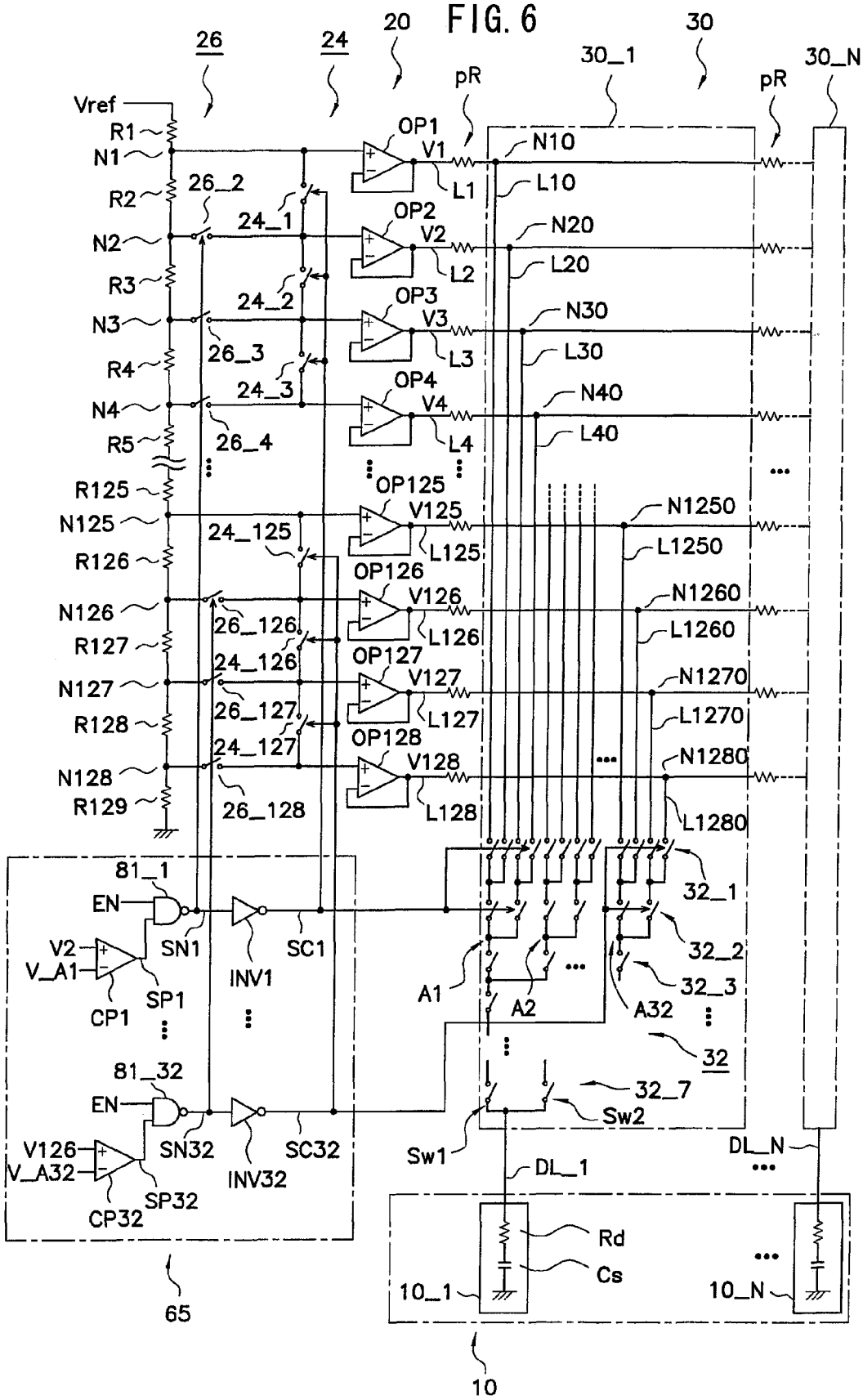
FIG. 6 is a diagram showing an example of circuit structure of a source driver and control unit structuring a variant example of the driving circuit of the first embodiment.

The driving circuit shown in FIG. 6 differs from the driving circuit shown in FIG. 2 in regard to structure of the switch group 26 and inputs to the comparators CP1 to CP32.

That is, in the driving circuit shown in FIG. 6, the switch group 26 includes a switch 26_2 provided between node N2 and the non-inverting input terminal of op amp OP2, a switch 26_3 provided between node N3 and the non-inverting input terminal of op amp OP3 and a switch 26_4 provided between node N4 and the non-inverting input terminal of op amp OP4, . . . , and a switch 26_126 provided between node N126 and the non-inverting input terminal of op amp OP126, a switch 26_127 provided between node N127 and the non-inverting input terminal of op amp OP127 and a switch 26_128 provided between node N128 and the non-inverting input terminal of op amp OP128.

Furthermore, the gradation potentials of the second nodes in the node groups are provided to the non-inverting input terminals of the comparators CP1 to CP32. For example, the gradation potential V2 of node N2 in node group GN1 is provided to the non-inverting input terminal of comparator CP1, and the gradation potential V126 of node N126 in node group GN32 is provided to the non-inverting input terminal of comparator CP32.

Figure 7A:
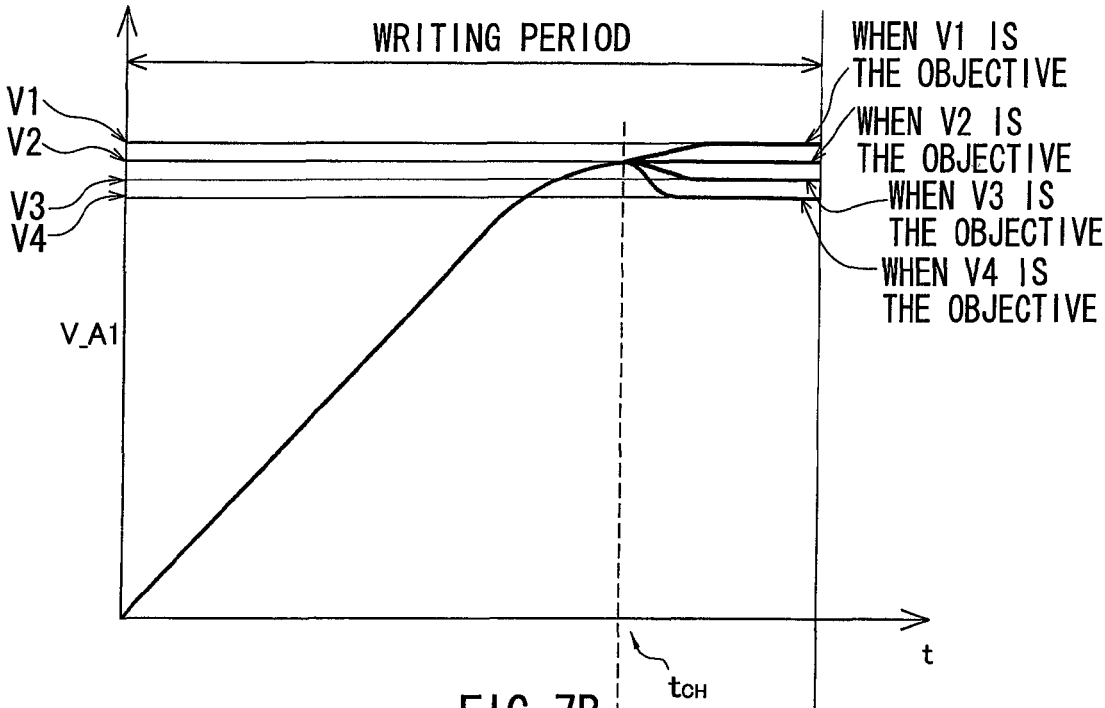
FIG. 7 is a timing chart showing operation of the variant example of the driving circuit of the first embodiment (when the objective gradation potential is high).
Figure 7B:
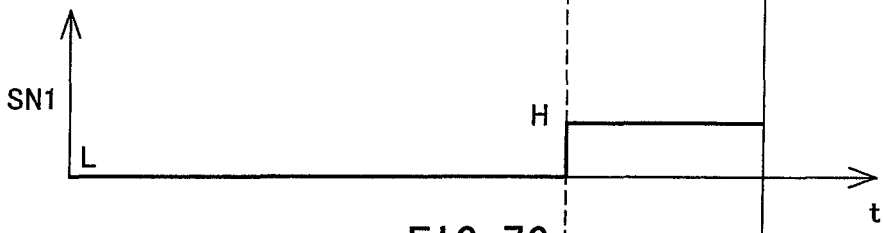
Figure 7C:
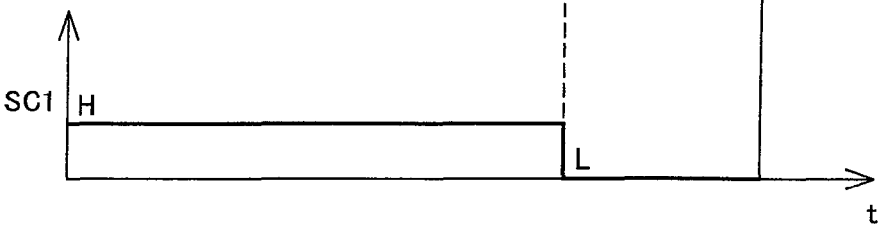
Figure 8A:
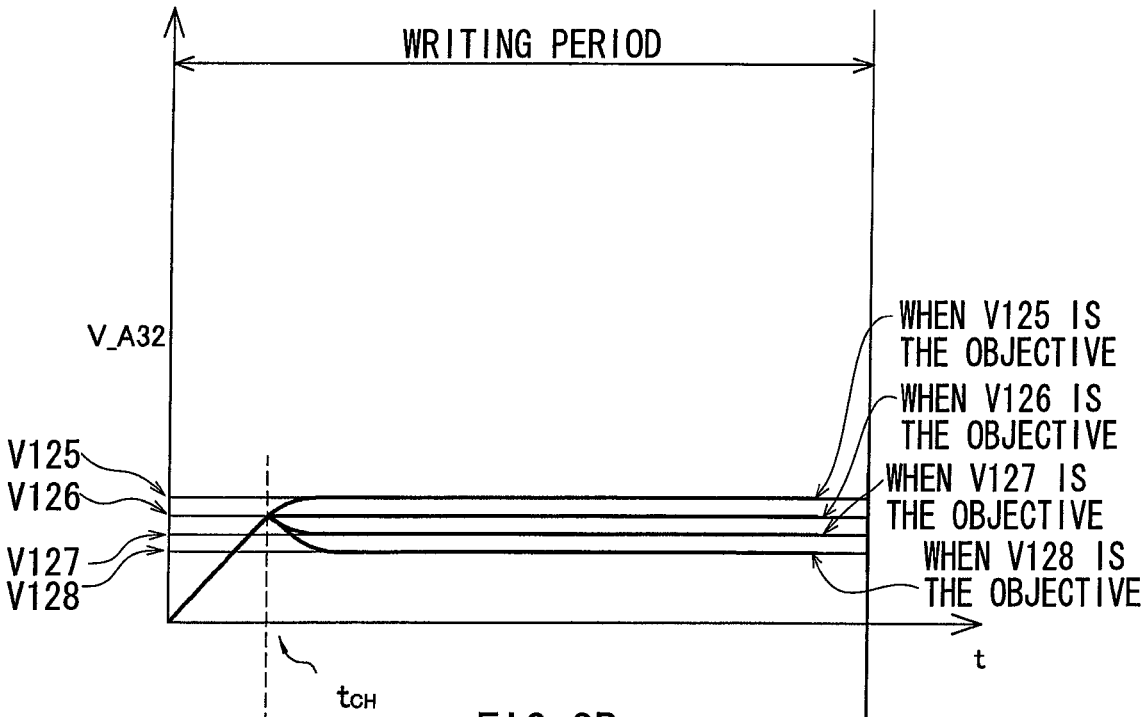
FIG. 8 is a timing chart showing operation of the variant example of the driving circuit of the first embodiment (when the objective gradation potential is low).
Figure 8B:
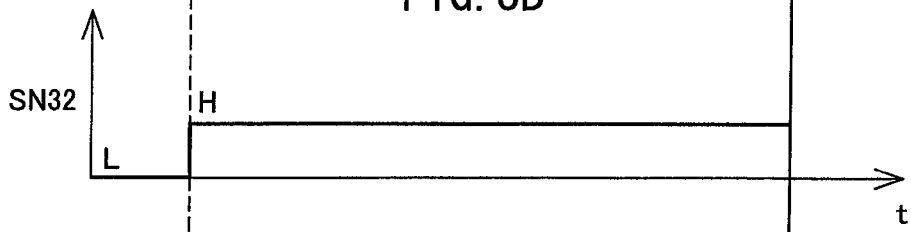
Figure 8C:
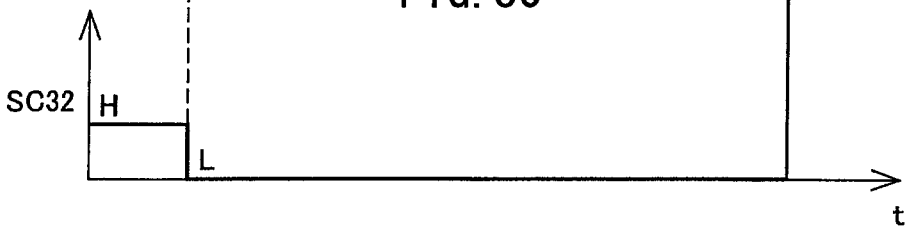

FIG. 7 and FIG. 8 are timing charts showing operations of the source driver shown in FIG. 6, and corresponding to FIGS. 4 and 5, respectively. The timing chart shown in FIG. 7 differs from the timing chart shown in FIG. 4 in that the second period is from a point in time at which the potential V_A1 of the node A1 reaches the gradation potential V2. Similarly, the timing chart shown in FIG. 8 differs from the timing chart shown in FIG. 5 in that the second period is from a point in time at which the potential V_A32 of the node A32 reaches the gradation potential V126.

Second Embodiment

Next, a second embodiment of the driving circuit of the present invention will be described. The driving circuit relating to the present embodiment differs from the driving circuit of the first embodiment only in that PMOS transistors are connected to each of the 32 nodes A1 to A32 in the switch group 32.

Structure of the driving circuit of the present embodiment will be described with reference to FIG. 9.

Figure 9:
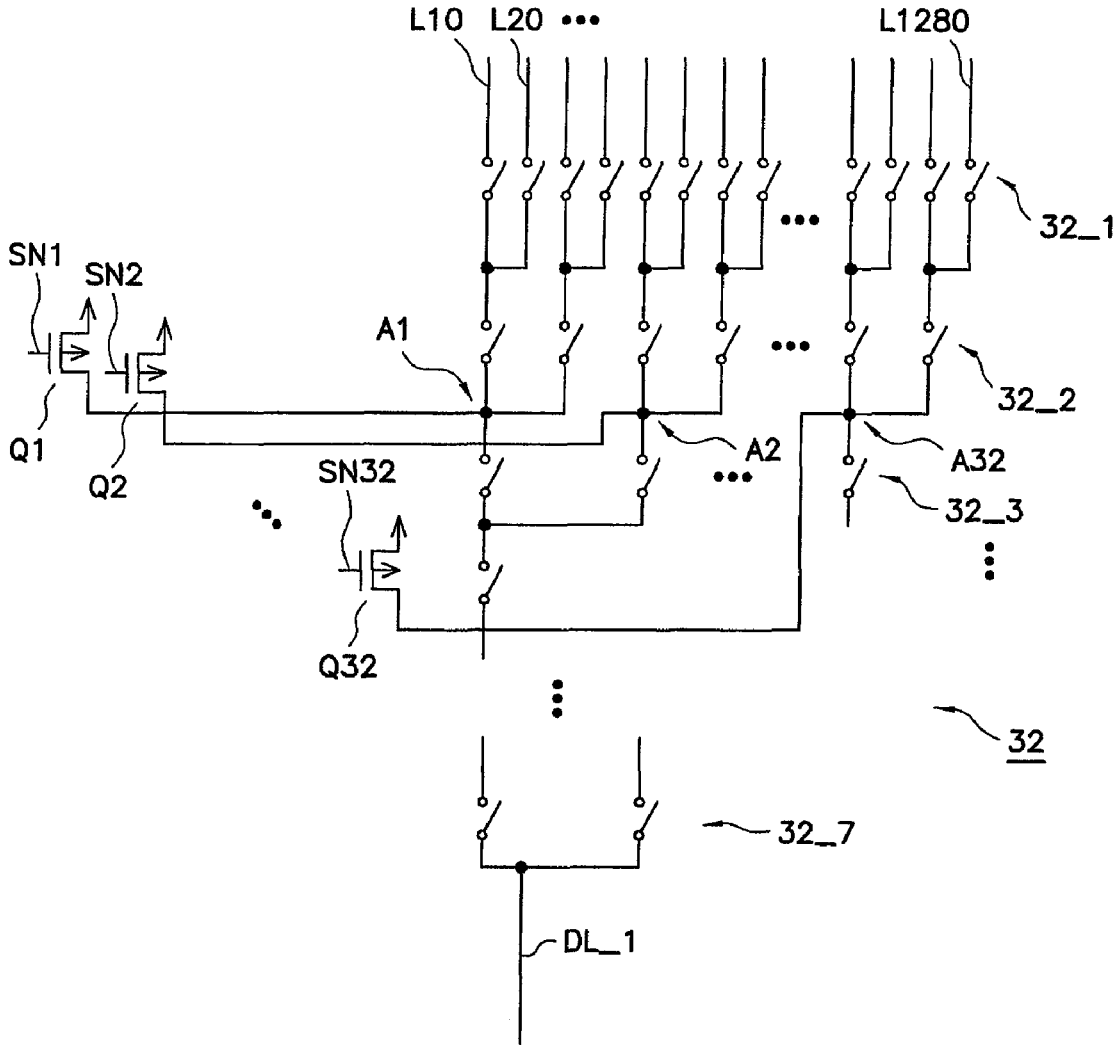
FIG. 9 is a diagram showing circuit structure of a portion of a source driver of a driving circuit of a second embodiment.

As shown in FIG. 9, in a source driver of this driving circuit, the drains of PMOS transistors Q1 to Q32 are connected to the nodes A1 to A32, respectively. The control signals SN1 to SN32 from the control signal generation unit 65 are provided to the gates of the PMOS transistors Q1 to Q32, respectively. The sources of the PMOS transistors Q1 to Q32 are connected to the reference potential Vref.

Figure 10:
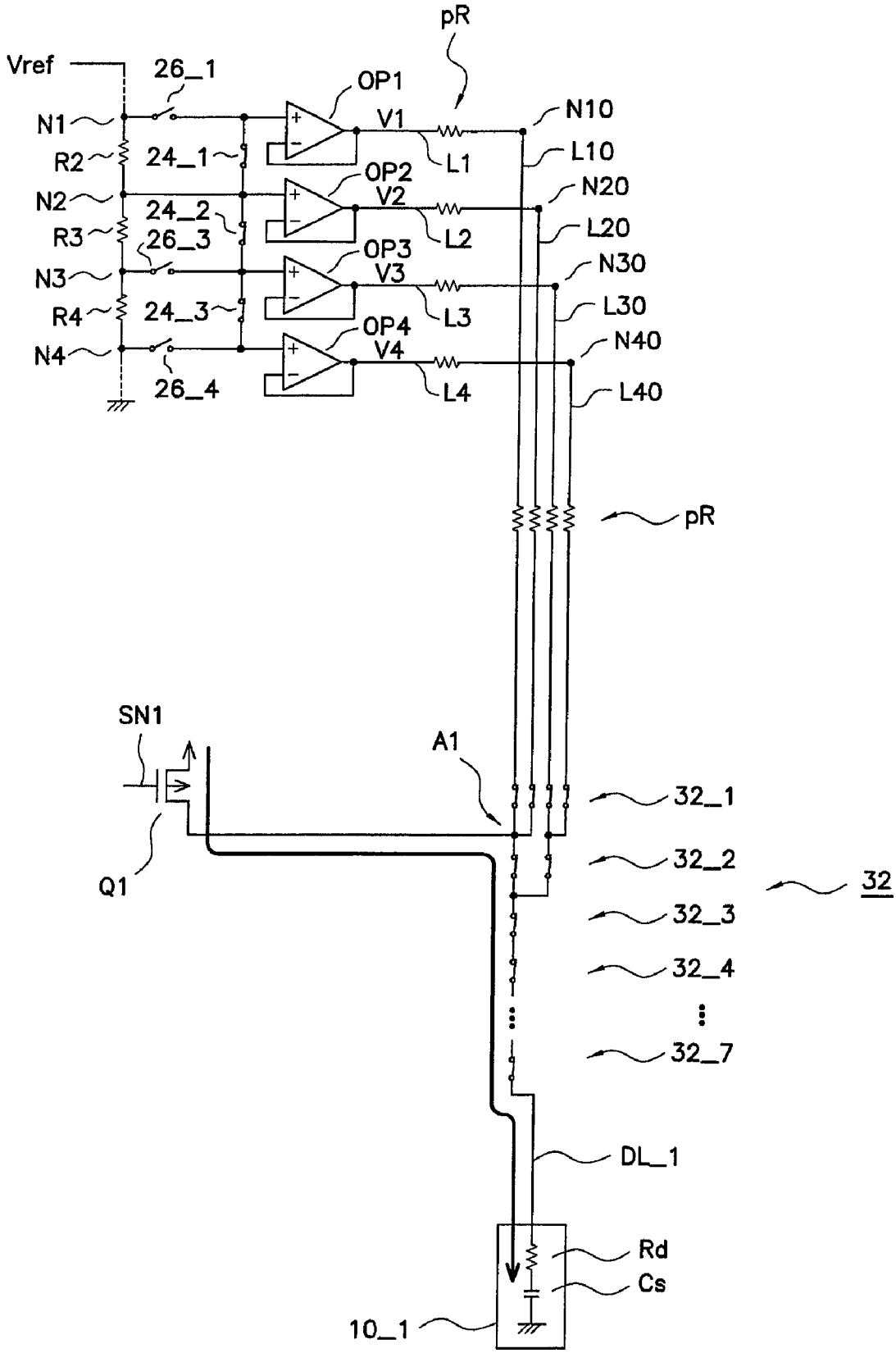
FIG. 10 is a diagram showing an example of an equivalent circuit, in the first period, of the source driver structuring the driving circuit of the second embodiment.

Next, operation of the driving circuit of the present embodiment will be described with reference to FIG. 10. FIG. 10 is a diagram showing an equivalent circuit, in the first period of the source driver 15, in a case in which the objective gradation potential is one of V1 to V4. Opening and closing states of the switch groups 24, 26 and 32 in FIG. 10 are the same as those illustrated in FIG. 3.

In the example shown in FIG. 10, the control signal SN1 is at the L level in the first period, and consequently the PMOS transistor Q1 is turned on. As a result, pixel 10_1 is rapidly charged up by the reference potential Vref, via the PMOS transistor Q1. In FIG. 10, a current for the charging is illustrated with an arrow. The potential of node A1 rises rapidly, and the level of the output signal SP1 of the comparator CP1 changes after a short period. Therefore, the first period finishes in a short duration.

Thus, the driving circuit of the present embodiment differs from the first embodiment in that, in the first period, rather than a pixel being charged by the gradation potential of a particular node in the node group that includes the node that is at an objective gradation potential, the pixel is charged by the reference potential Vref. Consequently, data-writing periods can be made shorter than with the first embodiment. By charging with the reference potential Vref, which is larger than all of the gradation potentials V1 to V128, a writing period for any of the objective gradation potentials can be made to be a shorter period.

Moreover, with this driving circuit, because the PMOS transistors for charging (Q1 to Q32) are provided, current-driving capabilities (dimensions such as channel width and the like) of output stage transistors of the op amps OP1 to OP128 can be made lower than in the case of the first embodiment. Therefore, a loop gain of each op amp can be reduced, and phase margins can be thoroughly assured. In consequence, more stable operations of the source driver are enabled.

Third Embodiment

Next, a third embodiment of the driving circuit of the present invention will be described. The driving circuit relating to the present embodiment differs from the driving circuit of the first embodiment in structure of the switch groups in the gradation-setting unit of the source driver and in the control signal generation unit 65 of the control unit 60.

Figure 11:
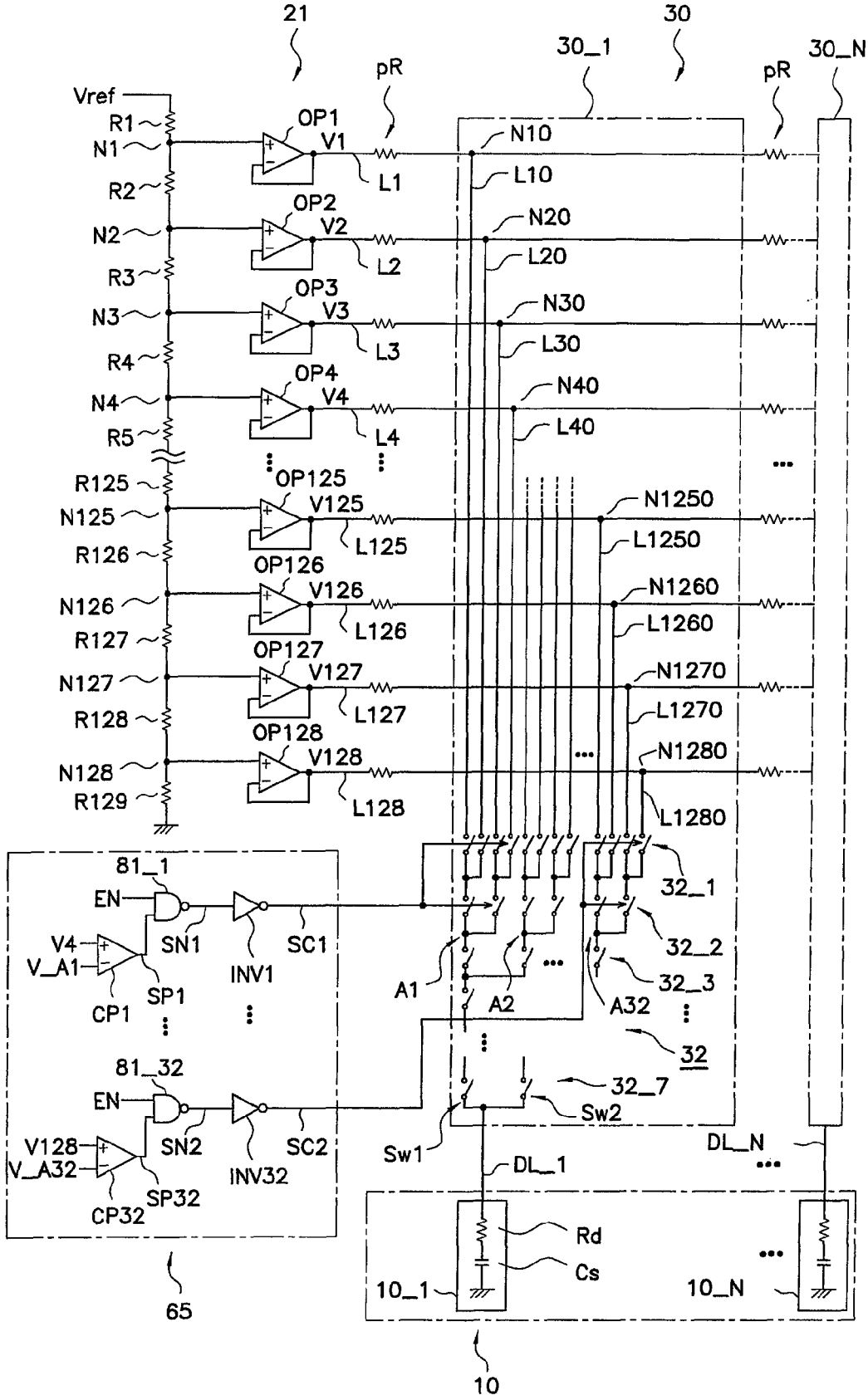
FIG. 11 is a diagram showing an example of circuit structure of a source driver and control unit structuring a driving circuit of a third embodiment.

FIG. 11 is a circuit diagram showing structure of a source driver of the present embodiment. Portions that are the same as in FIG. 2 are assigned the same reference numerals, and duplicative descriptions will not be given below.

Structure of Driving Circuit

As shown in FIG. 11, a gradation-setting unit 21 of the source driver of the present embodiment is not provided with the switch groups 24 and 26 of the gradation-setting unit 20 of the first embodiment.

Minimum potentials from the respective node groups are provided to the non-inverting input terminals of the comparators CP1 to CP32. For example, the lowest gradation potential V4 from node group GN1 is provided to the non-inverting input terminal of comparator CP1, and the lowest gradation potential V128 from node group GN32 is provided to the non-inverting input terminal of comparator CP32. The potentials V_A1 to V_A32 of nodes A1 to A32 in the switch group 32 are provided to the inverting input terminals of the comparators CP1 to CP32.

Operation of Driving Circuit

Figure 12:
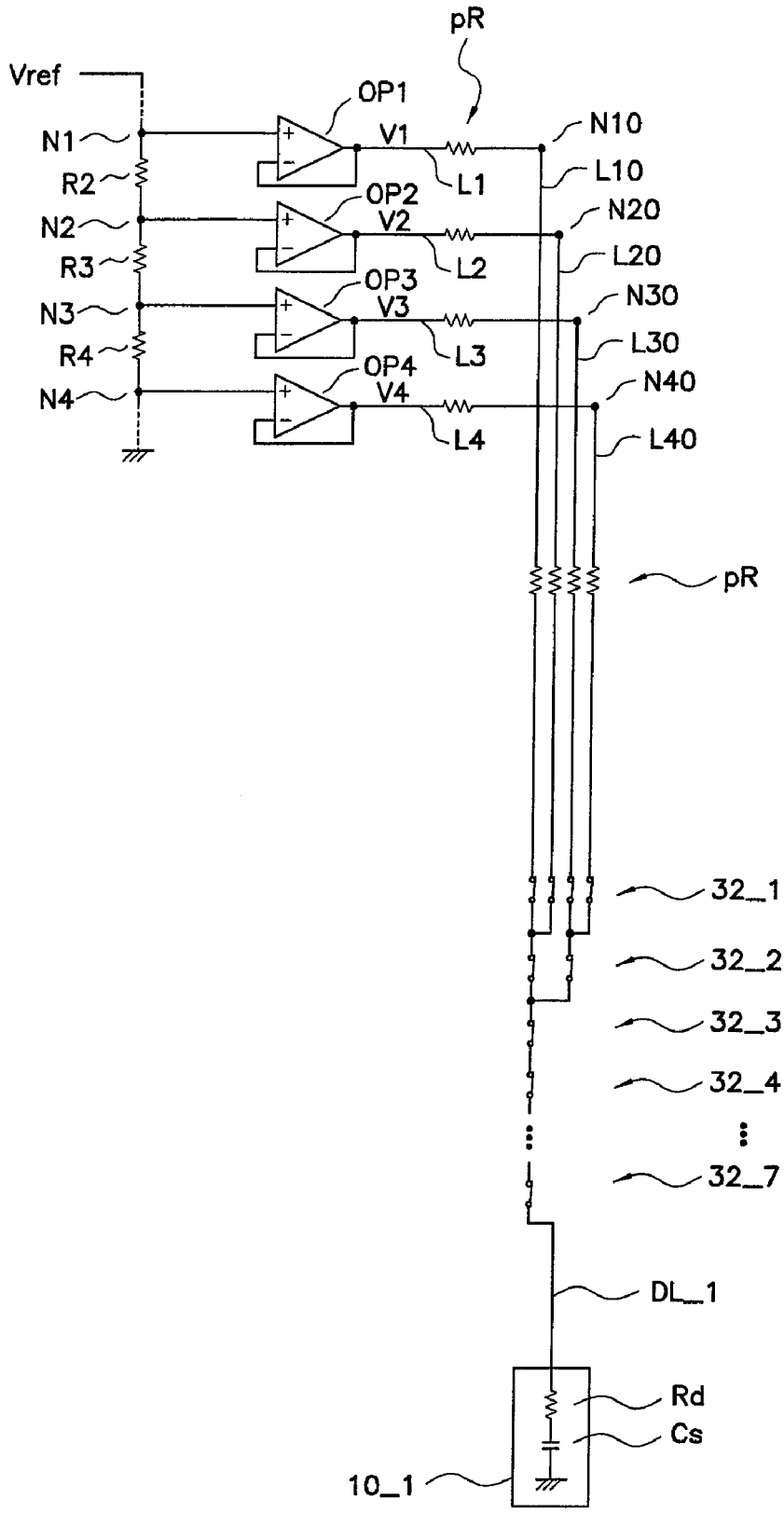
FIG. 12 is a diagram showing an example of an equivalent circuit, in the first period, of the source driver structuring the driving circuit of the third embodiment.
Figure 13A:
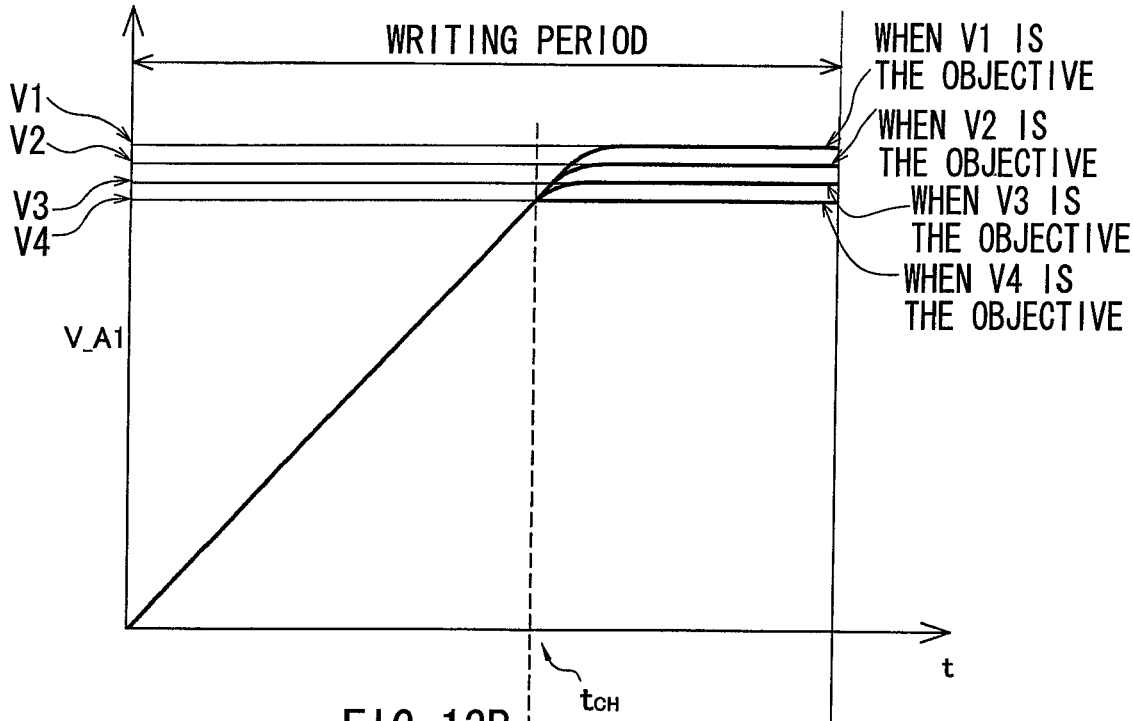
FIG. 13 is a timing chart showing operation of the driving circuit of the third embodiment (when the objective gradation potential is high).
Figure 13B:
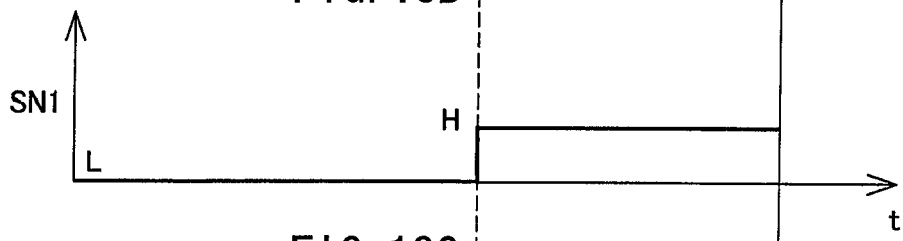
Figure 13C:
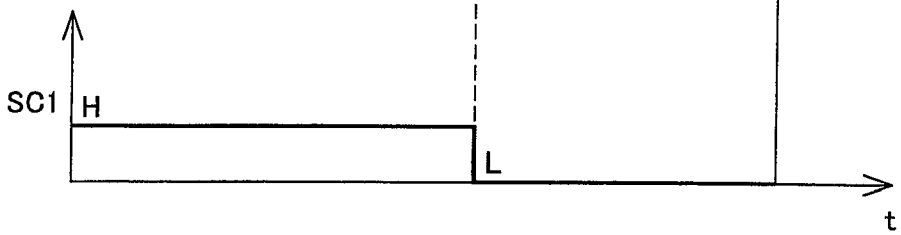
Figure 14A:
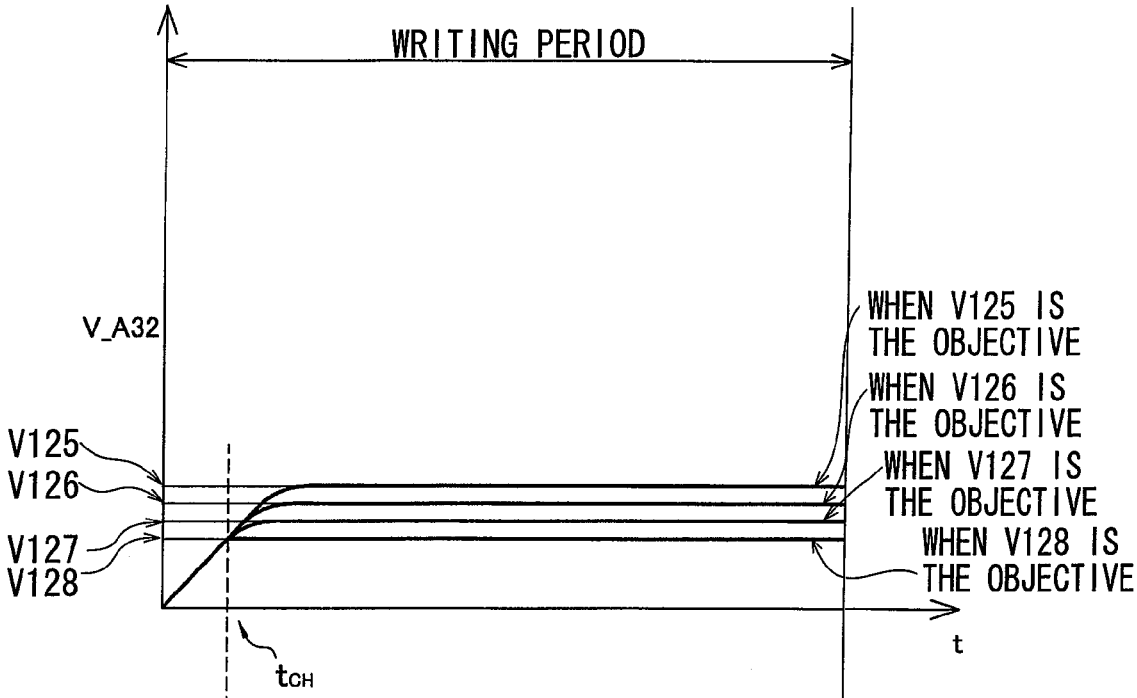
FIG. 14 is a timing chart showing operation of the driving circuit of the third embodiment (when the objective gradation potential is low).
Figure 14B:
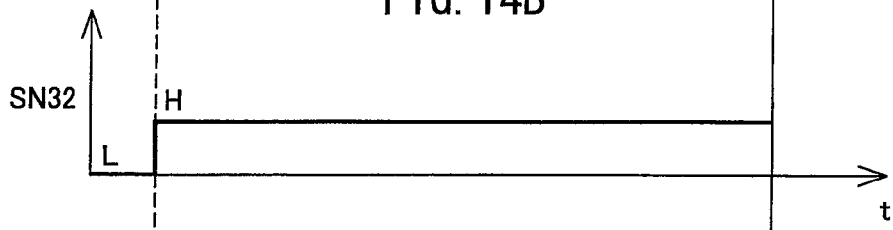
Figure 14C:
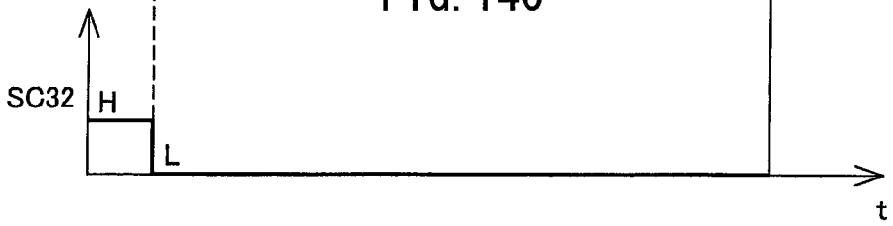

Next, operation of the driving circuit relating to this embodiment will be described with reference to FIG. 12 to FIG. 14. FIG. 12 is a diagram showing an equivalent circuit of the source driver in the first period when the objective gradation potential is one of V1 to V4. FIG. 13 is a timing chart showing operation of the source driver when the objective gradation potential is one of V1 to V4. FIG. 14 is a timing chart showing operation of the source driver when the objective gradation potential is one of V125 to V128. In FIG. 13A shows the potential V_A1 at node A1, FIG. 13B shows the control signal SN1, and FIG. 13C shows the control signal SC1. In FIG. 14A shows the potential V_A32 at node A32, FIG. 14B shows the control signal SN32, and FIG. 14C shows the control signal SC32. FIG. 13 and FIG. 14 correspond to the earlier-described FIG. 4 and FIG. 5, respectively.

Below, operation in a case in which the objective gradation potential is at one of the node group GN1 (nodes N1 to N4) will be described.

In the initial first period of the writing period, pixel 10_1 is not completely charged up but the potential V_A1 of node A1 is equal to or less than the potential V4 of node N4. Therefore, the output signal SP1 of the comparator CP1 is at the H level, and as shown in FIG. 4, the control signal SN1 is at the L level and the control signal SC1 is at the H level. Here, an equivalent circuit of the source driver for the first period can be represented as shown in FIG. 12. Thus, in the first period, the time constant of the CR circuit structured by the storage capacitance Cs of pixel 10_1 and a parasitic resistance pR falls to about a quarter compared to a case in which the short-circuit control mode is not applied, and this is similar to the first embodiment. At this time, the pixel 10_1 is being charged by the maximum gradation potential V1 of the node group GN1.

As charging of the pixel 10_1 progresses, the potential V_A1 of node A1 rises above the potential V4 of node N4 (at time $t_{CH}$ in FIG. 13), and the output signal SP1 of the comparator CP1 switches from the H level to the L level. The second period is from this time $t_{CH}$. In the second period, as shown in FIG. 13, the control signal SN1 is at the H level and the control signal SC1 is at the L level. Therefore, the switch device groups 32_1 and 32_2 corresponding to the bottom two bits of the display data open and close in accordance with the display data (i.e., the short-circuit control mode is released). Hence, as shown in FIG. 13, V_A1 alters toward the objective gradation potential after time $t_{CH}$.

Operation in a case in which the objective gradation potential is at one of node group GN32 (nodes N125 to N128) is similar (FIG. 14). However, as shown in FIG. 14 and similarly to the first embodiment, the time $t_{CH}$ of switching from the first period to the second period is earlier than in the case of FIG. 13.

In the driving circuit of the present embodiment, the purpose of inputting the minimum gradation potential in a corresponding node group to the non-inverting input terminal of the comparator (of CP1 to CP32) is to prevent excessive flows of current due to nodes of different potentials being short-circuited. For example, if the short-circuit control mode of FIG. 13 were to be implemented until the potential V_A1 reached the potential V1, then between the potential V_A1 passing potential V4 and reaching potential V1, large currents might flow between the output terminals of the op amps OP1 to OP4 at different potentials.

Furthermore, with this driving circuit, because the switch groups 24 and 26 are not provided, size of the circuit may be smaller than the driving circuit described for the first embodiment.

As has been described hereabove, according to the driving circuit of the present embodiment, similarly to the first embodiment, (1) delays in actual charging periods and (2) occurrences of offset currents between neighboring op amps (of OP1 to OP128) can be avoided.

Hereabove, a number of embodiments of the driving circuit of the present invention have been described. However, specific structures are not limited to these embodiments; design modifications and other improvements and the like in a scope not departing from the spirit of the present invention are to be included. For example, the technical features described for the second embodiment could be combined with the driving circuit of the third embodiment.

Furthermore, in the driving circuits of the embodiments described above, the nodes N1 to N128 of the gradation-setting unit have been grouped into node groups each of four neighboring nodes. However, this is not a limitation. It will be clear to one skilled in the art that it would be simple to specify that there be two or more neighboring nodes in each node group, and to amend structures of the switch groups 24, 26 and 32 correspondingly.

What is claimed is:

1. A driving circuit that, in accordance with display data, outputs a gradation potential corresponding to the display data from an output terminal, the driving circuit comprising:

a gradation-setting unit that, on the basis of a reference potential, sets a plurality of respectively different gradation potentials at a plurality of nodes;

a plurality of amplifiers provided one-to-one at the plurality of nodes;

a potential selection unit provided corresponding to the output terminal, the potential selection unit, in a data-writing period, selecting an objective gradation potential that corresponds to the display data from among the plurality of gradation potentials and outputting the objective gradation potential from the amplifier to the output terminal; and a control unit that controls such that, in a first period of the data-writing period, a first node of the plurality of nodes, which is set to the objective gradation potential, and at least one second node of the plurality of nodes neighboring the first node are short-circuited, and a second line, between the at least one second node and the output terminal, is connected in parallel with a first line that is between the first node and the output terminal, and in a second period subsequent to the first period, the short-circuit between the first node and the at least one second node is released and the second line is not connected in parallel with the first line, and the control unit effects a transition from the first period to the second period at a time at which the output terminal reaches a gradation potential corresponding to a third node of the plurality of nodes, wherein the third node is one of the first node and the at least one second node.

2. The driving circuit of claim 1, wherein the plurality of nodes comprises a plurality of node groups, in order of magnitude of the corresponding gradation potentials, when the first node is determined, each other node in a first node group, which includes the first node, is determined to be the at least one second node, and in the first period, a node of the first node group with a higher gradation potential than the third node is connected to the output terminal.

3. The driving circuit of claim 1, further comprising a plurality of transistors that turn on in the first period and provide a potential of at least the reference potential to the output terminal.

4. The driving circuit of claim 2, further comprising a plurality of transistors that turn on in the first period and provide a potential of at least the reference potential to the output terminal.

* * * * *